United States Patent [19]

Jennings

[11] Patent Number: 4,828,143

[45] Date of Patent: May 9, 1989

[54] ARTICLE DISPENSER

[76] Inventor: Kenneth L. Jennings, Rte. 2, Box 83-4, Strafford, Mo. 65757

[21] Appl. No.: 111,752

[22] Filed: Oct. 22, 1987

[51] Int. Cl.[4] ..... B65D 83/04

[52] U.S. Cl. ..... 221/266; 222/368; 384/275

[58] Field of Search ..... 221/266, 256, 257; 222/368, 369, 364, 363; 384/275; 401/214, 216

[56] References Cited

U.S. PATENT DOCUMENTS

| | | | |
|---|---|---|---|
| 3,122,278 | 2/1964 | Crozier | 222/363 |
| 3,276,636 | 10/1966 | Johnson | 221/266 |
| 3,318,491 | 5/1967 | Williamson | 221/266 |
| 3,782,608 | 1/1974 | Schneider | 221/266 |
| 4,189,066 | 2/1980 | Berghahn | 221/266 |
| 4,522,313 | 6/1985 | Jennings et al. | 221/256 |

*Primary Examiner*—H. Grant Skaggs
*Attorney, Agent, or Firm*—Leonard Tachner

[57] ABSTRACT

An article dispenser of the type having a sphere enclosed vessel, the sphere having at least one cavity for transferring an article, such as a pill, from inside the vessel to outside the vessel, employs a novel improvement in the manner of suspending the sphere on the vessel. Specifically, a cradle bridging the opening of the vessel provides a track of arcuate shape and the sphere has an annular groove of appropriate depth to form a central shaft for rotatably engaging the track. The sphere is readily removable for refilling the vessel and for assembly. A plurality of diagonally oriented guards assure free rotation of the sphere with articles being transferred in the cavity.

8 Claims, 2 Drawing Sheets

ARTICLE DISPENSER

BACKGROUND OF THE INVENTION

1. Field of the Invention

The present invention relates generally to the field of article dispensers and more specifically, to such dispensers designed for storing and ejecting articles of a solid nature such as capsules, pills and the like.

2. Prior Art

One type of article dispenser is disclosed by U.S. Pat. No. 3,276,636. Such dispenser shows a modified generally cylindrical roller with a U-shaped recess along most of the roller's length for delivering the article, and wherein the roller has a U-shaped support structure to receive the article. The roller is supported on a large area of the support structure and thus the total structured roller support and roller movement necessitates complex mechanization to effect the principal function of picking up an article and ejecting same.

U.S. Pat. No. 3,782,608 discloses a safety closure container wherein a sphere of two sections cooperating with each other results in a marking groove at the interface of the two sections, which groove is needed for alignment of movable components to effect the transfer of the article. The sphere has a depression for receiving the article. However, such sphere is mounted on a structure auxiliary to the vessel storing the article, and further mounted in such a way that the auxiliary structure cooperates with a substantial surface area of the sphere. The sphere has virtually an infinite number of degrees of freedom rotation along a plurality of axes in its auxiliary structure. Additionally, this art has protrusions near the sphere at an exit point of the article that prevent rotation of the sphere by contact of the sphere with a planar external surface upon exerting manual force upon the vessel.

U.S. Pat. No. 4,189,066 shows a hollow ball within an opening therein, the ball being retained in a support structure that permits its rotation in the support structure in a laterally infinite number of directions. The hollow ball retains the article and the opening is used to eject such article when such opening is aligned with certain structural members of the dispenser.

U.S. Pat. No. 3,318,491 shows a sphere modified by an angular portion that is removed from the sphere. Such sphere is dually supported by a support plug at a lower surface of the sphere and by a hemispherical cap at the upper surface of the sphere, such supports making a multiple number of contact points with the various areas of the sphere and making the sphere capable of rotation in any of a multiple number of directions. The sphere has a depression for receiving the article and such depression has to be aligned manually with an opening in the hemispherical cap by pushing a tab that is integral with the sphere structure and which protrudes outward from the sphere through the cap. Such protrusion also acts as an impediment to delivery of the article by rolling the sphere in contact with an external planar surface.

U.S. Pat. No. 1,716,883 is addressed to a smoker's cabinet which utilizes a hand-operated cylinder suspended from the cabinet walls, the cylinder having a slot to receive a cigarette from a hopper located above the cylinder and delivers the cigarette from an ejection means below the cylinder by manually rotating the cylinder so that the slot is 180 degrees displaced from its initial cigarette-receiving position. This structure provides no external access to the cylinder and hence does not promote the ability to impell the cylinder by contact of its surface with an external planar surface when the cabinet is manually pushed. Even if access to the external planar surface were provided, such cylinder would damage the article when its body rolls thereover upon article ejection.

U.S. Pat. No. 4,522,313 discloses an article dispenser having a sphere pivotally suspended from a vessel for rotation in only one direction about a singular first axis that is offset from a second axis, the second axis passing through the center of gravity of the sphere. The first axis lies in a plane that bisects the sphere into a pair of hemispheres where one of the hemispheres is heavier than the other hemisphere. The lighter hemisphere has a cavity overlying and adjacent the first axis and also adjacent to one of the pivotal suspension points. Pivotal suspension of the sphere requires a relatively high structure to support the pivot points thereby increasing the likelihood of interference with the dispensing operation. Furthermore, because there is no underlying support beneath the sphere within the vessel, the sphere can be jammed into the vessel thereby preventing improper operation of the dispenser. Furthermore, the sphere is relatively difficult to remove by the user, thus making it inconvenient to refill the bottle or vessel with pills. Difficulty may also be encountered in assembling the sphere to the vessel during the manufacturing of the dispenser.

SUMMARY OF THE INVENTION

The present invention overcomes the aforementioned deficiencies of the prior art by providing an article dispenser of the type having a vessel with an opening at one end, the opening being filled by a rotatable sphere having a pair of cavities for receiving and transferring pills from inside the vessel to outside the vessel, the sphere having an annular groove which rests on a ball cradle for rotation about a single axis passing through the center of the sphere by providing a bearing surface along the annular groove of the sphere as opposed to pivot points of the prior art. The present invention permits the use of a lower collar or ball support portion which is mounted to the vessel thereby reducing the likelihood of interference with the dispensing of the pills. Furthermore, because the ball cradle is positioned beneath the sphere to support the sphere along the shaft formed at the center of the annular groove thereof, the sphere cannot be jammed into the vessel which would otherwise detrimentally affect the performance of the dispenser. Furthermore, because of the relationship between the sphere and the underlying cradle, the sphere is easier to remove from the vessel by the user to refill the bottle with pills. More specifically, the present invention is designed to provide a sphere in a position for easy grasping so that the sphere can be raised above the vessel and removed therefrom thereby allowing easy access to the interior of the vessel so that pills can be added to the chamber within the vessel for reusing the dispenser. Easy placement and removal of the sphere from the vessel also simplifies assembly of the dispenser of the present invention thereby rendering it possible to manufacture the present invention at lower cost as compared to the prior art.

OBJECTS OF THE PRESENT INVENTION

It is therefore a principal object of the present invention to provide an improved article dispenser of the type having a sphere suspended over the chamber of a vessel or container, the sphere having at least one pocket or cavity for transferring an article from inside the vessel to outside the vessel upon rotation of the sphere.

It is an additional object of the present invention to provide an article dispenser of the aforementioned type wherein the sphere is suspended in a ball cradle, the sphere being provided with an annular groove leaving a shaft which rests on a track of the ball cradle thereby providing the sphere with an underlying support which prevents the sphere from being inadvertently jammed into the vessel which would otherwise detrimentally affect its operation.

It is still an additional object of the present invention to provide an article dispenser of the type having a sphere suspended above a vessel the sphere having at least one cavity for transferring a solid object such as a pill from the interior of the vessel to the exterior of the vessel for access thereto, the sphere being readily removable and replaceable in the vessel to facilitate filling the vessel with solid articles and also to facilitate assembly of the invention.

BRIEF DESCRIPTION OF THE DRAWINGS

The aforementioned objects and advantages of the present invention as well as additional objects and advantages thereof will be more fully understood hereinafter as a result of a detailed description of a preferred embodiment when taken in conjunction with the following drawings in which.

DETAILED DESCRIPTION OF A PREFERRED EMBODIMENT OF THE INVENTION

Figure 5:
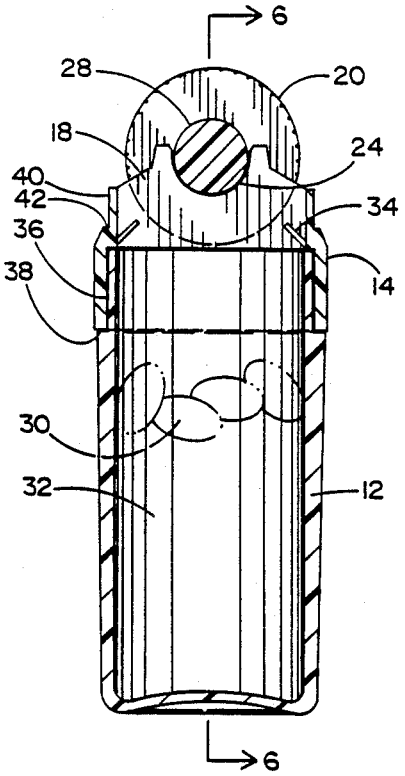
FIG. 5 is a cross-sectional view of the invention taken along lines 5—5 of FIG. 4.
Figure 6:
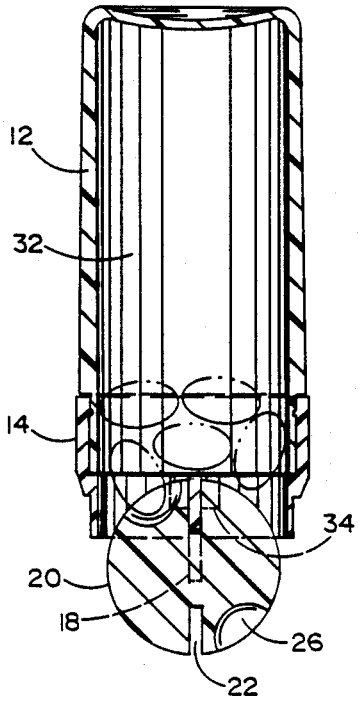
FIG. 6 is a cross-sectional view of the invention taken along lines 6—6 of FIG. 5 but with the vessel inverted showing the manner in which an article inside the vessel is contained within a cavity thereof.
Figure 7:
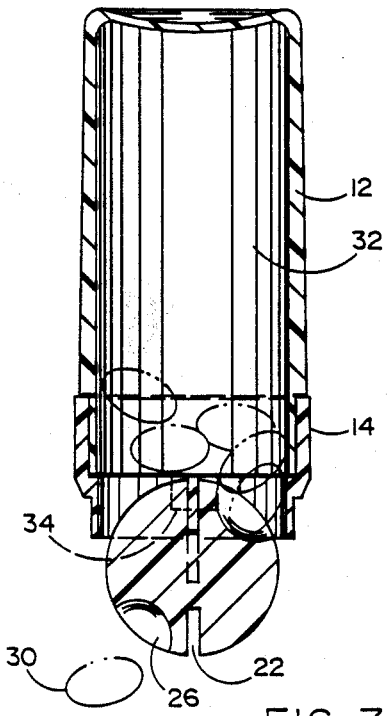
FIG. 7 is a cross-sectional view similar to that of FIG. 6 but showing the sphere in a slightly different configuration relative to the vessel.

Referring now to FIGS. 1–7 it will seen that the pill dispenser 10 of the present invention comprises a vessel or container 12, a ball support portion 14, a cap 16 and a sphere 20. The sphere 20 is pereferably of a solid structure and includes an annular groove 22 extending around the entire perimeter of the sphere and extending into the center of the sphere about half-way, leaving a shaft 28 of cylindrical configuration. Sphere 20 also provides at least one and preferably two cavities 26 each of which is of the appropriate depth and shape to receive a pill 30 as shown in FIGS. 6 and 7. In the event that there are two such cavities 26 it is preferable to locate the cavities on symmetrical opposing points on the sphere 20 adjacent the annular groove 22 as seen best in FIGS. 3 and 4.

Figure 1:
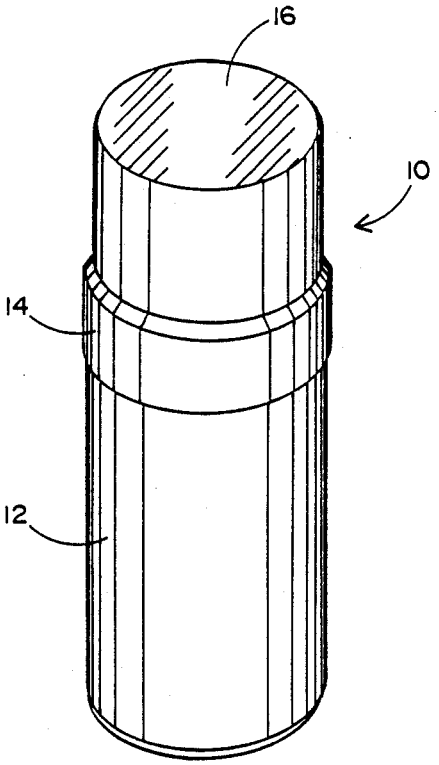
FIG. 1 is a perspective view of the article dispenser of the present invention shown in its fully assembled configuration.
Figure 2:
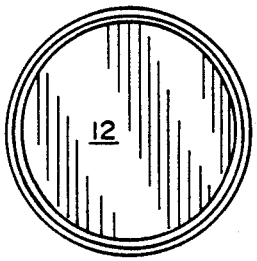
FIG. 2 is a bottom view of the article dispenser.
Figure 3:
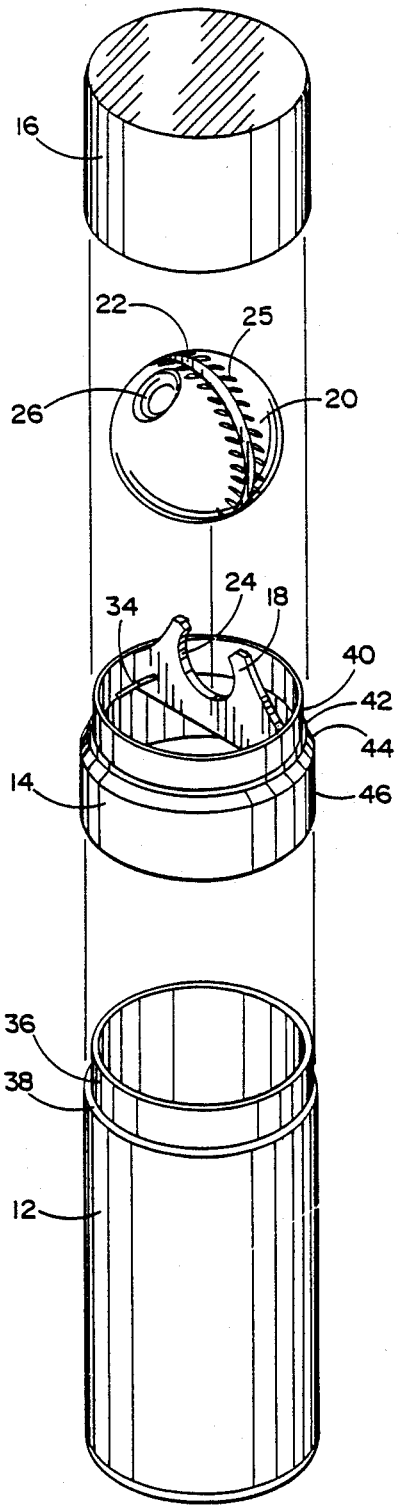
FIG. 3 is an exploded view of the article dispenser of the present invention.
Figure 4:
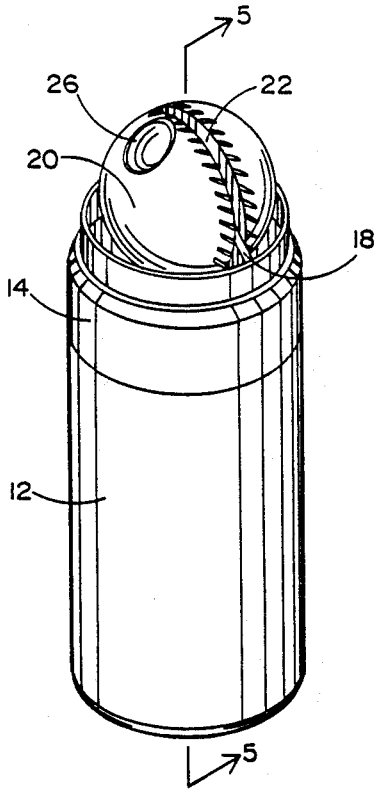
FIG. 4 is a perspective view of the invention similar to that of FIG. 1 but showing the invention with its cap removed.

As seen best in FIGS. 3 and 5, the ball support portion 14 is provided with a ball cradle 18 which forms a C-shaped track 24. Ball cradle 18 and the track 24 are properly dimensioned to receive the sphere 20 so that the cylindrical shaft 28 of the sphere 20 rests in rotational engagement with the track 24 with a portion of the annular groove 22 overlaping the adjacent surfaces of ball cradle 18 on either side of the track 24 and in slideable engagement with such surfaces. Also, as seen best in FIGS. 3 and 4 the exterior surface of sphere 20 immediately adjacent the annular groove 22 is preferably provided with knurling 25 to facilitate easy frictional engagement with and thus rotation of the sphere 20 to operate the dispenser 10 herein in the manner described.

As seen best in FIG. 3, the ball support portion 14 comprises a first annular surface 40, a shoulder 42, a chamfered incline 44 and a second annular surface 46. Ball cradle 18 is preferably affixed to the inside of first annular surface 40 with the lowermost portion of track 24 at about the level corresponding to the top of first annular surface 40 and the remainder of the track extending above that surface. In this manner, the sphere 20 is positioned relative to container or vessel 12 and ball support portion 14 in such a way that the center of shaft 28 extends above the top of the ball support portion thereby rendering it more convenient to grasp the sphere for removing same from the track 24 or reinstalling it within the track 24. The shoulder 42 of the ball support portion 14 provides a convenient stop for the cap 16 when the dispenser 10 of the invention is fully assembled. Similarly, the vessel or container 12 provides an annular recess 36 extending around the top portion thereof and terminating in a shoulder 38 which provides a convenient stop for the press fit engagement between the container and the ball support portion 14.

The present invention in its preferred embodiment also provides a set of guards 34 which are seen best in FIGS. 3, 5, 6 and 7. One such guard 34 is positioned at a diagonal orientation at each of the four corners formed between the interface of the ball cradle 18 and the ball support portion 14 adjacent the inside surface of first annulus 40. The angular orientation and location of guards 34 are designed to prevent any pills 30 from being inadvertently jammed between the sphere 20 and the interior of ball support portion 14 which would otherwise detrimentally effect the performance of the article dispenser 10. In this manner, a pill 30 is readily forced by gravity into a cavity 26 when the dispenser 10 of the present invention is inverted as shown in FIGS. 6 and 7. As a result, when the sphere 20 is rotated with a pill 30 contained within a cavity 26, the pill or other article with which the invention is used is transported from the interior or chamber 32 to the exterior of the dispenser 10 where it is relatively easy to grasp the pill or allow the pill to fall from the cavity onto the palm or other surface provided by the user.

Thus, it will be seen that the present invention overcomes the aforementioned deficiencies of the prior art by providing an article dispenser of the type which uses a rotating sphere mounted on top of an open ended vessel. The sphere is of the type having one or more cavities for transferring an article such as a pill of appropriate size from the interior of the vessel to the exterior thereof as a result of conveyance within the cavity upon rotation of the sphere. It will be understood that the present invention provides certain novel improvements over the prior art, one of the most significant such improvement being the use of a ball cradle configuration which positions the center of the sphere above the upper lip of the vessel on a track to which an annular groove of the sphere is press fit thereby enabling easy assembly as well as removal and replacement of the sphere for filling and refilling the vessel for dispensing. The relationship between the sphere and the ball cradle provides an additional advantage, namely, underlying support for the sphere which prevents inadvertent compression of the ball into the vessel which would otherwise detrimentally affect the performance of the dispenser. Another significant advantage of the invention is the use of a plurality of guards positioned and oriented relative to the sphere within the vessel to assure that none of the articles can be jammed between the wall of the vessel and the sphere which would otherwise prevent proper operation of the dispenser.

Those having skill in the relevant art will now, as a result of the applicant's teaching herein, perceive various modifications and additions which may be made to the invention. By way of example, the specific shape and dimensions of the sphere, the cavities in the sphere and the relationship between the sphere and the underlying vessel and ball cradle are all shown herein as examples only and may be altered without deviating from the applicant's teaching herein. Accordingly, the present invention is to be limited only by the claims appended hereto.

I claim:

1. A dispenser comprising a vessel and a sphere rotatably mounted at an opening of the vessel, said sphere having at least one cavity for transferring an article stored inside said vessel to outside said vessel upon rotation of said sphere, said dispenser further comprising a cradle mounted at said vessel opening and having an arcuate track, said sphere having an annular groove forming a centrally positioned shaft on said sphere for rotatably engaging said track, said cradle being positioned relative to said vessel whereby more than one-half of said sphere is external to said vessel opening to permit grasping of said sphere for removal from said vessel.

2. The dispenser recited in claim 1 wherein said vessel comprises a container for holding said articles and a ball support portion to which said cradle is attached, said container and said ball support portion being attachable to one another in a press-fit engagement.

3. The dispenser recited in claim 2 further comprising a cap for mating with said ball support portion while enclosing said sphere.

4. The dispenser recited in claim 2 wherein said container, said ball support portion and said sphere are each made of a plastic material.

5. The dispenser recited in claim 1 wherein said cradle is everywhere thinner than said annular groove and is suspended across said opening whereby upon removal of said sphere articles may be readily added to or removed from said vessel through said opening.

6. The dispenser recited in claim 1 further comprising a plurality of guards each such guard positioned adjacent said cradle adjacent said opening for directing an article into said cavity.

7. The dispenser recited in claim 1 wherein said sphere is knurled along its exterior surface adjacent saod annular groove.

8. The dispenser recited in claim 1 wherein said sphere is solid except for said annular groove.

* * * * *